US007520098B1

(12) United States Patent
Martinique et al.

(10) Patent No.: US 7,520,098 B1
(45) Date of Patent: Apr. 21, 2009

(54) STEPPED TILE SHINGLE

(75) Inventors: Jeff Martinique, Edwardsville, KS (US); Tim Gentry, Mission Hills, KS (US); Rick Fitzpatrick, Berthoud, CO (US); John Humphreys, Mission Hills, KS (US)

(73) Assignee: DaVinci Roofscapes, LLC, Kansas City, KS (US)

( * ) Notice: Subject to any disclaimer, the term of this patent is extended or adjusted under 35 U.S.C. 154(b) by 205 days.

(21) Appl. No.: 11/037,442

(22) Filed: Jan. 18, 2005

Related U.S. Application Data

(60) Provisional application No. 60/537,418, filed on Jan. 16, 2004.

(51) Int. Cl.
*E04D 3/00* (2006.01)

(52) U.S. Cl. ..... 52/309.2; 52/553; 52/787.1; 52/523

(58) Field of Classification Search ..... 52/309.2, 52/787.1, 553, 523, 560; 428/120, 143–149
See application file for complete search history.

(56) References Cited

U.S. PATENT DOCUMENTS

| | | | | | |
|---|---|---|---|---|---|
| 2,624,298 | A | * | 1/1953 | Farren | 52/533 |
| 2,735,143 | A | * | 2/1956 | Kearns | 52/521 |
| 2,830,546 | A | | 4/1958 | Rippe | |
| 3,060,163 | A | | 10/1962 | Erchak | |
| 3,269,075 | A | | 8/1966 | Cosden | |
| 3,347,001 | A | | 10/1967 | Cosden | |
| 3,579,940 | A | * | 5/1971 | Greenleaf | 52/542 |
| 3,667,184 | A | | 6/1972 | Merrill | |
| 3,852,934 | A | | 12/1974 | Kirkhuff | |
| 3,903,340 | A | | 9/1975 | Shepherd | |
| 3,983,675 | A | | 10/1976 | Pearse | |
| 4,010,590 | A | | 3/1977 | Reinke | |
| 4,067,256 | A | * | 1/1978 | Turner | 411/437 |
| 4,141,187 | A | | 2/1979 | Graves | |
| 4,193,898 | A | | 3/1980 | Miller | |
| 4,214,918 | A | | 7/1980 | Grat | |
| 4,252,603 | A | | 2/1981 | Kharsas et al. | |
| 4,268,572 | A | | 5/1981 | Toland | |
| 4,301,633 | A | * | 11/1981 | Neumann | 52/309.4 |
| 4,514,947 | A | | 5/1985 | Grail | |
| 4,914,885 | A | | 4/1990 | Baker | |
| 5,070,671 | A | | 12/1991 | Fitfield | |
| 5,174,092 | A | | 12/1992 | Naden | |
| 5,189,083 | A | | 2/1993 | Gelles et al. | |
| 5,190,997 | A | | 3/1993 | Lindemann et al. | |
| 5,214,082 | A | | 5/1993 | Gelles et al. | |
| 5,215,598 | A | | 6/1993 | Konzuma | |
| 5,305,570 | A | | 4/1994 | Rodriguez | |
| 5,437,735 | A | | 8/1995 | Younan et al. | |
| 5,502,940 | A | | 4/1996 | Fitfield | |
| 5,528,872 | A | | 6/1996 | Rotter | |
| 5,575,861 | A | | 11/1996 | Younan et al. | |

(Continued)

*Primary Examiner*—Brian E. Glessner
*Assistant Examiner*—Adriana Figueroa

(57) ABSTRACT

A shingle includes a body having an upper end, a lower end, a top surface, a bottom surface, a first side and a second side. The body has a width defined as the distance between the two opposing sides, a length defined by the distance between the upper end and the lower end. In a preferred embodiment, the shingle also includes a side wall that extends downward from the body adjacent one of the sides and extends the length of the shingle. The side wall preferably includes an angular projection disposed toward the upper end.

4 Claims, 4 Drawing Sheets

U.S. PATENT DOCUMENTS

| | | | | |
|---|---|---|---|---|
| 5,603,758 | A | 2/1997 | Schreifels, Jr. et al. | |
| 5,613,337 | A | 3/1997 | Plath | |
| 5,615,523 | A | 4/1997 | Wells et al. | |
| 5,644,886 | A | 7/1997 | Ekmark | |
| 5,711,126 | A * | 1/1998 | Wells | 52/519 |
| 5,784,848 | A | 7/1998 | Toscano | |
| 5,902,683 | A | 5/1999 | Sieloff | |
| 5,974,756 | A | 11/1999 | Alvarez | |
| 6,070,384 | A | 6/2000 | Chich | |
| 6,120,913 | A | 9/2000 | Kluttz et al. | |
| 6,178,703 | B1 | 1/2001 | Noone | |
| 6,180,871 | B1 | 1/2001 | Campbell | |
| 6,194,519 | B1 | 2/2001 | Blalock et al. | |
| 6,233,895 | B1 | 5/2001 | Evans | |
| 6,282,858 | B1 | 9/2001 | Swick | |
| 6,415,562 | B1 * | 7/2002 | Donaghue et al. | 52/177 |
| 6,418,692 | B1 | 7/2002 | Freshwater et al. | |
| 6,530,189 | B2 * | 3/2003 | Freshwater et al. | 52/553 |
| 6,540,829 | B2 | 4/2003 | Allman et al. | |
| RE38,210 | E | 8/2003 | Plath et al. | |
| 6,619,006 | B1 | 9/2003 | Shirota | |
| 6,679,308 | B2 | 1/2004 | Becker et al. | |
| 6,715,252 | B2 | 4/2004 | Stahl et al. | |
| 6,729,081 | B2 | 5/2004 | Nath et al. | |
| 6,758,019 | B2 | 7/2004 | Kalkanoglu et al. | |
| 6,808,785 | B1 | 10/2004 | Friedman | |
| 6,907,702 | B2 | 6/2005 | Gilbert et al. | |
| 7,003,922 | B2 | 2/2006 | Fitfield | |
| 7,118,794 | B2 | 10/2006 | Kalkanoglu et al. | |
| 7,125,601 | B1 | 10/2006 | Pinault | |
| 7,140,153 | B1 | 11/2006 | Humphreys | |
| 7,155,866 | B2 | 1/2007 | Bezubic, Jr. et al. | |
| 7,241,500 | B2 | 7/2007 | Shiao et al. | |
| 2002/0189188 | A1 | 12/2002 | Iole et al. | |
| 2006/0260731 | A1 | 11/2006 | Kalkanoglu | |
| 2007/0107356 | A1 | 5/2007 | Steffes | |
| 2008/0028705 | A1 | 2/2008 | Morse | |

* cited by examiner

STEPPED TILE SHINGLE

RELATED APPLICATIONS

This application claims the benefit of U.S. Provisional Patent Application Ser. No. 60/537,418, entitled Stepped Tile Shingle, filed Jan. 16, 2004, the disclosure of which is herein incorporated.

FIELD OF THE INVENTION

The present invention is generally related to improved building materials and more particularly related to shingles useable in roofing applications.

BACKGROUND OF THE INVENTION

Shingles are typically small pieces of building material that are used in overlapping rows to protect the interior of a house from inclement weather. Historically, shingles have been constructed from a number of compositions, including natural slate, metal, fibrous cement, ceramics, clay and asphalt compounds.

Prior art shingles are typically rectangular shaped and have substantially flat top and bottom surfaces. These types of shingles are customarily installed by securing a first horizontal row of shingles along the bottom of the roof in a line parallel to the eave of the roof. Subsequent horizontal rows of shingles are then layered in partially overlapping fashion up the inclined surface of the roof. In this way, the exposed portion of the top surface of one shingle covers the upper portion of a lower, underlying shingle.

Although widely accepted, this method of applying shingles to a roof suffers a number of drawbacks. For example, it is very difficult to maintain consistent alignment of the horizontal rows of shingles across the entire roof surface. The improper positioning of a single shingle can produce an exaggerated misalignment of subsequent shingles that are positioned next to any previously laid shingle that is out-of-alignment. Furthermore, as illustrated in the prior art drawing in FIG. 7, a small wedge-shaped recess, or "gap" 200 is formed between two overlapping, flat-bottomed shingles 202 and the starter shingle 204. These gaps 200 permit the shingle 202 to bend when pressure is applied to the top of the shingle. For example, when a roofing contractor walks across a roof 206 during installation or subsequent maintenance, the shingle 202 bends under the weight of the worker. As the shingle 202 bends, cracks may develop in the shingle 202 that compromise the ability of the shingle to provide a watertight seal on the roof 206.

Accordingly, there is a need for an improved shingle that overcomes these and other deficiencies in the prior art.

SUMMARY OF THE INVENTION

The present invention is generally directed at improved roofing shingles. A shingle constructed in accordance with a preferred embodiment includes a body having an upper end, a lower end, a top surface, a bottom surface, a first side and a second side. The body has a width defined as the distance between the two opposing sides and a length defined by the distance between the upper end and the lower end. In a preferred embodiment, the shingle also includes a side wall that extends downward from the body adjacent one of the sides and extends the length of the shingle. The side wall preferably includes an angular projection disposed toward the upper end. Other preferred embodiments of the inventive shingle include braces to support the shingle on a roofing surface and fastener reinforcements.

DETAILED DESCRIPTION OF THE PREFERRED EMBODIMENT

Figure 1:
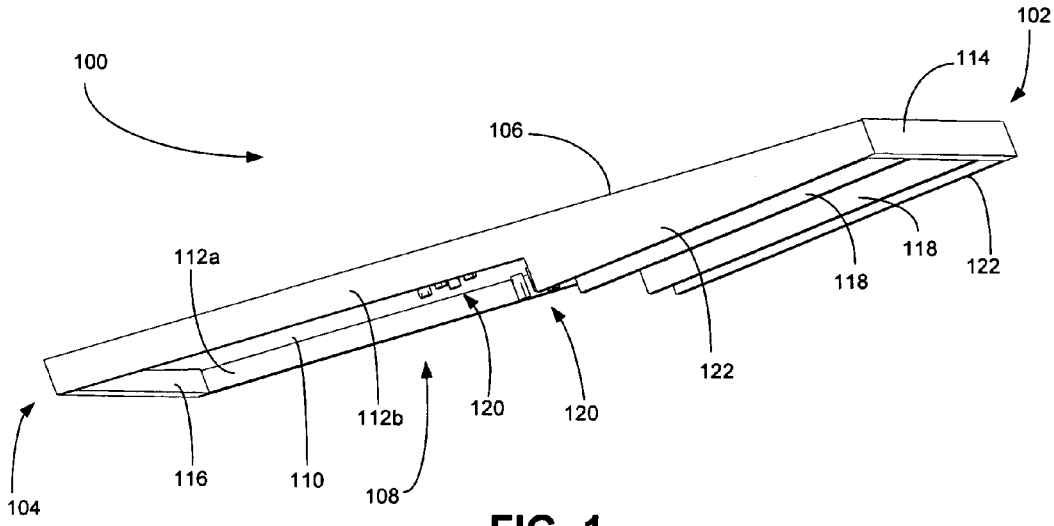
FIG. 1 is a perspective view of a shingle constructed in accordance with a preferred embodiment of the present invention.

Turning to FIG. 1, shown therein is a side perspective view of a shingle 100 constructed in accordance with a presently preferred embodiment. The shingle generally has an upper end 102, a lower end 104, a top surface 106, and an underside 108. The shingle 100 preferably includes a body 110, a first side wall 112*a*, a second side wall 112*b* (collectively "side walls 112"), a dam 114 and a lip 116. The shingle has a width defined as the distance between the side walls 112 and a length defined as the distance between the dam 114 and the lip 116. The shingle 100 also preferably includes a plurality of braces 118 and a plurality of fastener reinforcements 120.

Unless otherwise specified, each component within the shingle 100 is constructed from synthetic materials. In a particularly preferred embodiment, the shingle 100 is constructed from plastic that exhibits suitable flexibility and resilience to enable the use of nails or other fasteners during the installation of the shingle 100. In a particularly preferred embodiment, the shingles 110 are constructed using injection-molding or die-cast techniques. Although the shingles 100 shown in the preferred embodiment are configured as independent shingles, it will be understood that each single shingle 100 could be manufactured in a wider width in a way that creates a single, continuous panel having the appearance of multiple, smaller shingles.

The side walls 112 preferably extend downward from the body 110 and extend along the length of the shingle 100. In this way, the side walls 112 give the shingle 100 a thicker profile than the body 110. The side walls 112 also include a fin, or "angular projection" 122, that extends downward from the upper end 102 of the shingle 100. The angular projection 122 creates a stepped-profile that is advantageous for several reasons.

Figure 2:
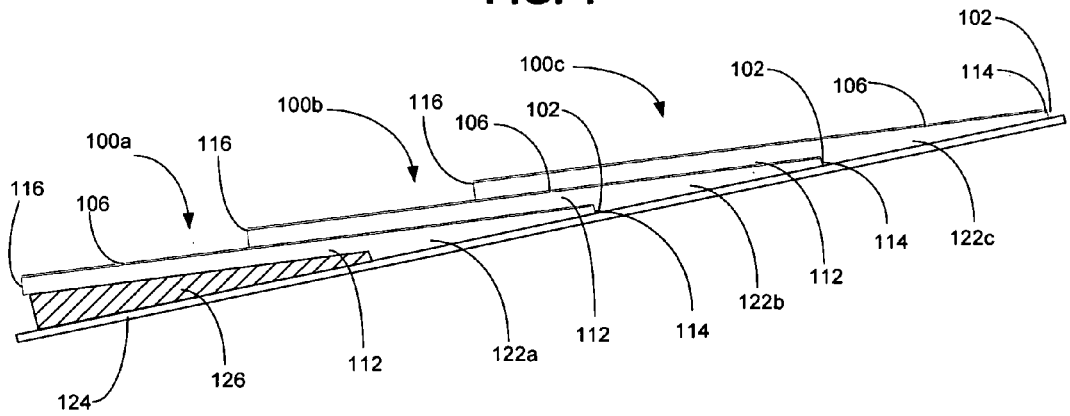
FIG. 2 is a side elevational view of the three shingles of FIG. 1 as installed on a roof.

As shown in FIG. 2, the geometry of the stepped profile of the side walls 112 is configured such that the angular projection 122 contacts the upper end 102 of an adjacent lower shingle 100 and rests on a roof surface 124. For example, the angular projection 122*b* of shingle 100*b* contacts the upper end 102*a* of shingle 100*a*. In this way, the shingle 100*b* can be easily installed with reference to shingle 100*a* with little margin of error by simply hanging shingle 100*b* on the lower shingle 100*a*. The automatic alignment provided by the stepped side walls 112 greatly facilitates the installation of overlapping shingles in subsequent courses. In a particularly preferred embodiment, the side walls 112 are angled with respect to the top surface 102 to adjust the angle elevation of the shingles 100 off the roof.

In addition to facilitating and improving installation operations, the side walls 112 of the shingles 100 also eliminate the presence of the wedge-shaped recesses or "gaps" that result from the overlapped installation of conventional rectangular shingles. In the preferred embodiment, the angular projection 122 is configured to substantially occupy the space or "gap" that would be present with standard planar rectangular shingles. In this way, the angular projection 122 effectively seals the underside 108 of the shingle 100, thereby increasing the reinforcing strength between the top surface 106 and the roof surface 124. At the same time, the side walls 112 are configured to accommodate the use with a traditional "starter" shingle 126, which eliminates the space between the underside 108 and the roof surface 124 created by the stepped side walls 112 on the first horizontal row of shingles 100 along the eave of the roof surface 124.

Figure 3:
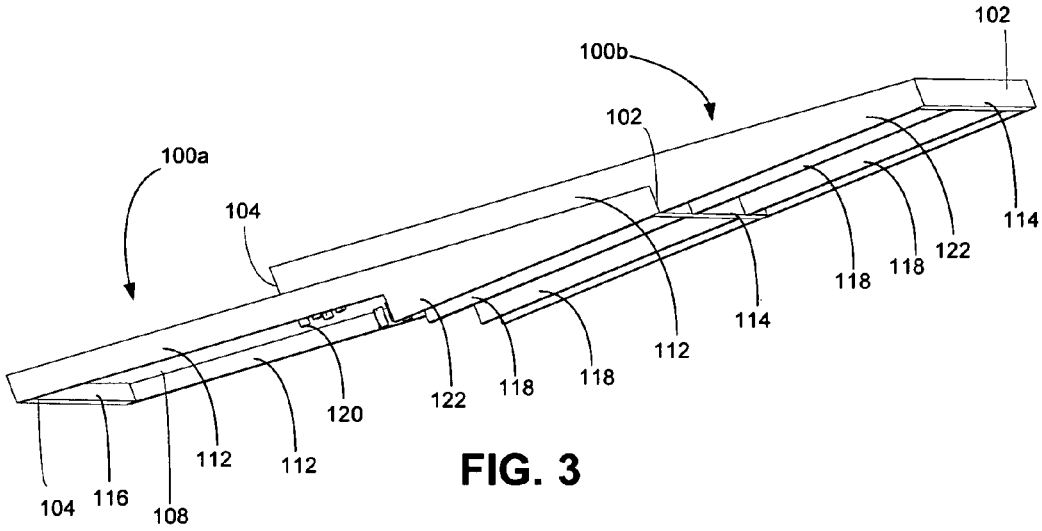
FIG. 3 is a perspective view of two shingles constructed in accordance with the preferred embodiment.
Figure 4:
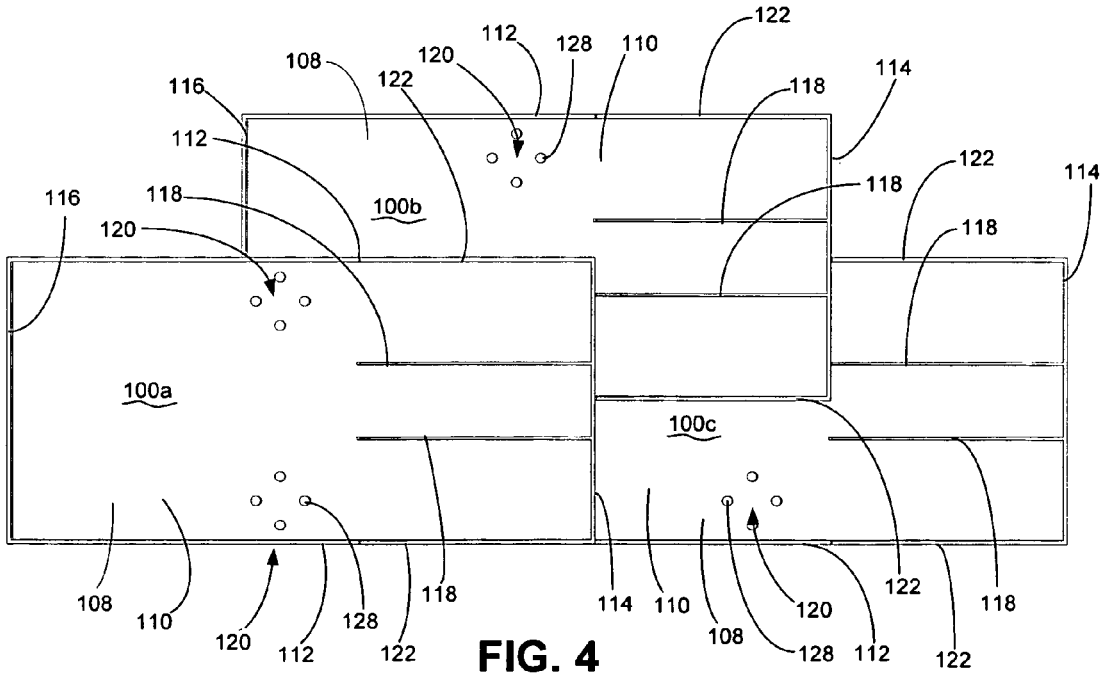
FIG. 4 is a bottom plan view of three shingles constructed in accordance with a preferred embodiment.

FIGS. 3-4, shown therein are a bottom perspective view and bottom plan view, respectively, of shingles 100 constructed in accordance with the preferred embodiment. The dam 114 preferably extends across the width of the shingle 100 at the upper end 102 and preferably rests on the roof surface 124 when installed. The dam 114 prevents moisture and wind from passing under the shingle 100 from the upper end 108. Similarly, the lip 116 extends across the width of the shingle 100 at the lower end 104 and preferably rests on the top surface 106 of an adjacent lower shingle 100. The lip 116 prevents moisture and wind from passing under the shingle 100 from the lower end. Thus, the lip 116, dam 114 and side walls 112 collectively seal the underside 108 of the shingle 100 from wind or moisture.

The braces 118 are preferably connected to the body 110 and the dam 114 and extend a portion of the length of the shingle 100. The braces 118 enhance the resistance of the shingle 100 to impact from debris or hail as well as from compression under a sustained weight, such as the weight of a contractor standing on the shingle 100. Although two braces 118 are shown in FIGS. 3 and 4, it will be understood the fewer or greater numbers of braces 118 could also be used. In the presently preferred embodiment, the braces 118 are configured in geometric congruence with the angular projections 122 of the side walls 112. In this way, the braces 118 are useful for supporting overlapping shingles 100 when laterally offset.

Figure 5:
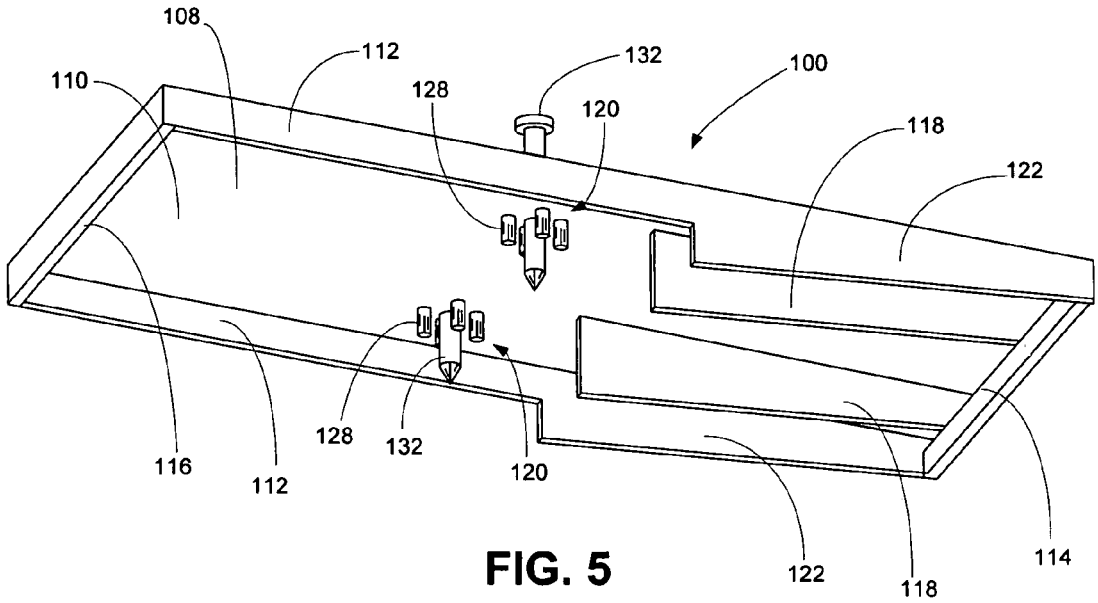
FIG. 5 is a bottom perspective view of the shingle of FIG. 1.
Figure 6:
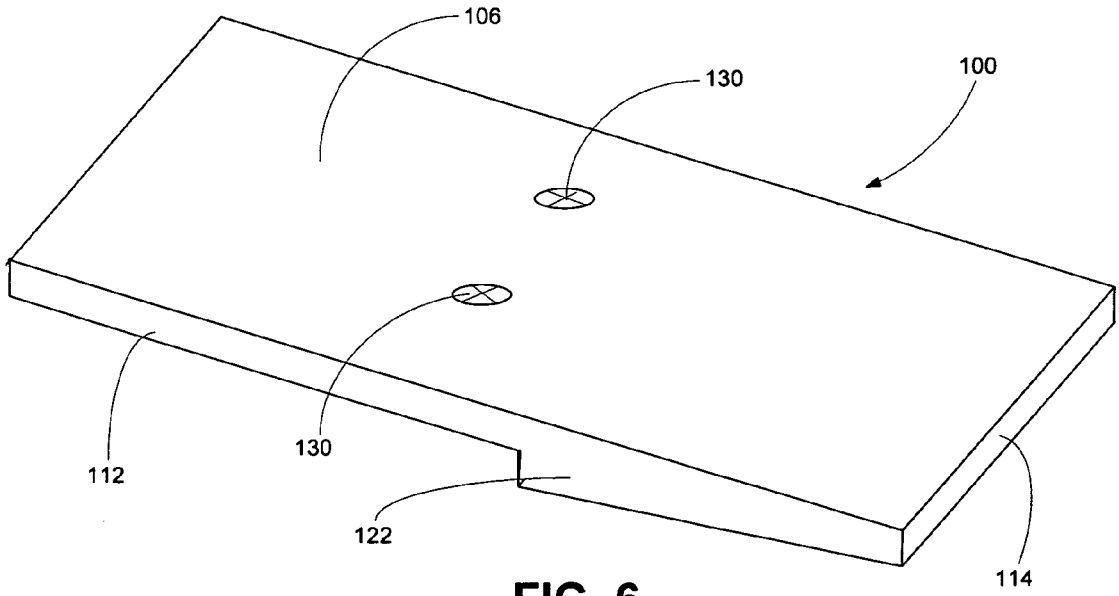
FIG. 6 is a top perspective view of the shingle of FIG. 1.
Figure 7:
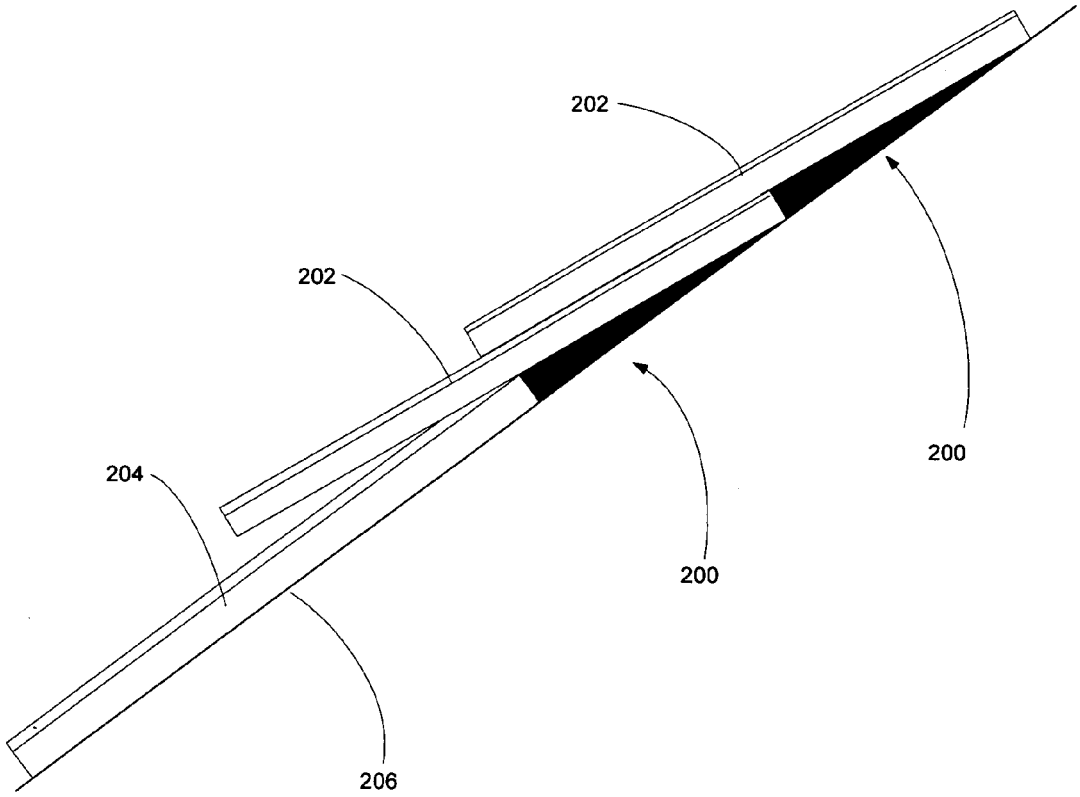
FIG. 7 PRIOR ART
FIG. 7 is a side elevational view of several prior art shingles.

Turning now to FIGS. 5 and 6, shown therein are bottom and top perspective views of the shingle 100, respectively. As shown in FIGS. 5 and 6, the fastener reinforcements 120 include a plurality of support columns 128 and a fastener target 130. The support columns 128 preferably extend from the body 110 downward toward the roof surface 124. The support columns 128 are preferably spaced-apart to receive a fastener 132 inserted through the body 110 from the top surface 106. The fastener target 130 is preferably placed on the top surface 106 to indicate the optimal location to place the fastener 132. The support columns 128 prevent the shingle 100 from buckling or weakening under the pressure of the fastener 132. Although four support columns 128 have been shown in the preferred embodiment, it will be understood that alternative fastener reinforcements, featuring greater or fewer support columns, or even single large cylinders, for example, are also within the scope of the present invention.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed herein, in the associated drawings and appended claims.

It is claimed:

1. A shingle configured for attachment to a roof surface using a fastener, the shingle comprising:

a body comprising an upper end, a lower end, a top surface, a bottom surface, a first side and a second side, wherein the body has a width defined as the distance between the first side and the second side, a length defined by the distance between the upper end and the lower end;

a first side wall extending downward from the body adjacent the first side and extending the length of the shingle, wherein the first side wall comprises an angular projection disposed toward the upper end;

a second side wall extending downward from the body adjacent the second side and extending the length of the shingle, wherein the second side wall comprises an angular projection disposed toward the upper end; and a fastener reinforcement, wherein the fastener reinforcement comprises (i) a fastener target on the upper surface of the body, wherein the fastener target indicates an insertion point for the fastener, and (ii) a plurality of individual support columns extending from the bottom surface of the body around the insertion point spaced such that when the fastener is inserted at the insertion point, the fastener will not come into contact with any support column.

2. The shingle of claim 1, wherein the shingle further comprises a plurality of braces extending downward from the bottom surface of the shingle and spaced between the first side and the second side, wherein each of the plurality of braces is configured in congruency with the angular projection of the first side wall.

3. The shingle of claim 1, wherein the shingle comprises a plurality of fastener reinforcements.

4. A shingle configured for attachment to a roof surface using a fastener, the shingle comprising:

a body comprising an upper end, a lower end, a top surface, a bottom surface, a first side and a second side, wherein the body has a width defined as the distance between the first side and the second side, a length defined by the distance between the upper end and the lower end;

a first side wall extending downward from the body adjacent the first side and extending the length of the shingle, wherein the first side wall comprises (i) an angular projection disposed toward the upper end, wherein the angular projection comprises a lower end, (ii) a first height at the upper end, (iii) a second height at the lower end, and (iv) an angular projection height at the lower end of the angular projection, wherein the angular projection height is substantially equal to the first height of the first side wall;

a second side wall extending downward from the body adjacent the second side and extending the length of the shingle, wherein the second side wall comprises (i) an angular projection disposed toward the upper end, wherein the angular projection comprises a lower end, (ii) a first height at the upper end, (iii) a second height at the lower end, and (iv) an angular projection height at the lower end of the angular projection, wherein the angular projection height is substantially equal to the first height of the second side wall, and wherein the first height of the second side wall is substantially equal to the first height of the first side wall, the second height of the second side wall is substantially equal to the second height of the first side wall, and the angular projection height of the second side wall is substantially equal to the angular projection height of the second side wall;

a dam extending downward from the body adjacent the upper end and extending continuously the width of the shingle, wherein the darn comprises a height that is substantially equal to the first heights of the first side wall and the second side wall;

a lip extending downward from the body adjacent the lower end and extending continuously the width of the shingle, wherein the lip comprises a height that is substantially equal to the second heights of the first side wall and the second side wall;

a brace extending downward from the bottom surface of the shingle between the first side and the second side, wherein the brace is configured in congruency with the angular projection of the first side wall; and a fastener reinforcement, wherein the fastener reinforcement comprises (i) a fastener target on the upper surface of the body, wherein the fastener target indicates an insertion point for the fastener, and (ii) a plurality of individual support columns extending from the bottom surface of the body around the insertion point spaced such that, when the fastener is inserted at the insertion point, the fastener will not come into contact with any support column.

* * * * *